US006770041B2

(12) United States Patent
Rastegar et al.

(10) Patent No.: US 6,770,041 B2
(45) Date of Patent: Aug. 3, 2004

(54) EXTERNAL COUNTERPULSATION CARDIAC ASSIST DEVICE PRESSURE APPLICATORS HAVING AN OUTER SHELL WHICH RESISTS DEFORMATION

(75) Inventors: Jahangir S. Rastegar, Stony Brook, NY (US); Harry Soroff, Northport, NY (US)

(73) Assignee: P.P.T.T. L.L.P, Northport, NY (US)

( * ) Notice: Subject to any disclaimer, the term of this patent is extended or adjusted under 35 U.S.C. 154(b) by 81 days.

(21) Appl. No.: 10/135,032

(22) Filed: Apr. 29, 2002

(65) Prior Publication Data

US 2003/0204151 A1 Oct. 30, 2003

(51) Int. Cl.[7] ..... A61H 31/00
(52) U.S. Cl. ..... 601/44; 601/152
(58) Field of Search ..... 601/41, 44, 148–152

(56) References Cited

U.S. PATENT DOCUMENTS 2,360,476 A * 10/1944 Church ..... 601/44
2,597,637 A * 5/1952 Heidenwolf ..... 601/45
2,707,948 A * 5/1955 Emerson ..... 601/44
2,899,955 A * 8/1959 Huxley, III et al. ..... 601/44
3,865,102 A * 2/1975 Birtwell et al. ..... 601/152
4,762,121 A * 8/1988 Shienfeld ..... 601/152
4,838,263 A * 6/1989 Warwick et al. ..... 601/44

* cited by examiner

*Primary Examiner*—Danton D. DeMille
(74) *Attorney, Agent, or Firm*—Scully, Scott Murphy & Presser

(57) ABSTRACT

An applicator for applying an external counterpulsation to a body portion is provided. The applicator including: an outer shell for covering the body portion, the outer shell having a length in a longitudinal direction and a circumference in a circumferential direction; a balloon disposed in the outer shell, pressurization of which applies an external pressure to the body portion; and at least one anti-deformation member for reducing an amount of deformation of the outer shell caused by the pressurization of the balloon.

31 Claims, 6 Drawing Sheets

EXTERNAL COUNTERPULSATION CARDIAC ASSIST DEVICE PRESSURE APPLICATORS HAVING AN OUTER SHELL WHICH RESISTS DEFORMATION

INCORPORATION OF RELATED APPLICATION

This application relates to U.S. patent application Ser. No. 09/851,930 filed on May 10, 2001, the entire contents of which is incorporated herein by its reference.

BACKGROUND OF THE INVENTION

1. Field of the Invention

The present invention relates generally to external counterpulsation cardiac assist devices, and more particularly, to external counterpulsation cardiac assist device pressure applicators having an outer shell that resists deformation.

2. Prior Art

In the existing external counterpulsation cardiac assist device (ECPCAD) applicators (hereinafter "applicators"); limb pressure is generated by inflating balloon-like chambers that surround the limb. In addition, to keep the volume of the inflow air in check, the balloon-like chambers are encased in a relatively non-extensible fabric to minimize the bulging out of the applicator assembly.

The longitudinal and transverse cross-sections of a typical applicator as mounted on a patient thigh are shown in FIGS. 1 and 2, respectively. In these illustrations, the limb 100 is encased in the outer shell 102. The space between the limb surface and the outer shell 102 is filled with a balloon 101. Such applicator designs with the outer shell 102 consisting of relatively non-extensible fabric type of material are currently in common use. The outer shell 102 of the applicator and its underlying balloon 101 are generally made wider than usually necessary, and while applying the applicator to the limb, it is overlaid to tightly cover the limb surface and is held in place by an extended VELCRO strap (not shown) or some other similar means.

The applicator is used by laying the patient on a bed, "wrapping" the applicator around the limbs, usually the legs, the thighs, arms, buttock, etc., and affixing the outer shell 102 by VELCRO or other similar means so that the assembly stays tightly over the limbs. Part of the limb such as the ankles, knees, feet, elbows, chest area, neck and the head are not covered since due to the absence of a considerable amount of muscle mass, no significant amount of blood can be displaced by the external pressure.

The amount of fluid (i.e., gas or liquid) that is required to operate each applicator is dependent on at least several factors.

Firstly, the amount of fluid that is required to operate each applicator is dependent on the initial volume (space) between the lining and the balloon and the balloon and the limb (if any) that has to be occupied by the expanding balloon. The effects of this factor is usually countered by attempting to wrap the applicator as closely to the limb surface as possible and leaving as little as possible space (volume or void space) to be filled by the balloon during the pressure application process. This precludes so-called rigid outer shells of various forms that have a fixed inner volume and are to be used on different patients with different limb geometry even though it may be attempted to fill at least part of the gap between the patients limb and such rigid outer shells using variously shaped and various material inserts. The process of filling such gaps is extremely cumbersome and cannot fill all the existing gaps since it is almost impossible to construct the required three-dimensionally shaped inserts, particularly in the presence of highly flexible balloons that are located between the "rigid" outer shell and the limb.

The amount of fluid that is required to operate each applicator is also dependent on the amount of reduction in the volume of the segment of the limb that is enclosed by the applicator due to the applied pressure by the balloon and the level of limb surface pressure that has to be reached. These factors correspond to the desired and useful action of the applicator, which results in the blood pumping action of the device. The required airflow cannot therefore be reduced without reducing the volume of the blood that is displaced, thereby reducing the effectiveness of the applicator.

The amount of fluid that is required to operate each applicator is further dependent on the amount of increase in the applicator volume due to the expansion, bulging and change in the cross-sectional shape of its relatively non-extensible outer shell. This factor is indicative of the relative ease with which the outer shell of the applicator can expand and deform to allow its total internal volume (within which the encased segment of the limb is located) to increase with increased balloon generated internal pressure. This increase in the enclosed volume does not serve any purpose as far as the operation and performance of the applicator is concerned, and greatly reduces the efficiency of the applicator operation and it is the main source of increased demand on the air inflow to achieve the desired level of (limb) surface pressure during each cycle of its operation.

The amount of fluid that is required to operate each applicator is still further dependent on the volume of the soft tissue that may be pushed out of the sides of the applicator enclosure as the balloon is pressurized and pressure is applied to the limb segment. This factor also reduces the efficiency of the applicator by allowing some soft tissue mass to be pushed out of the enclosed volume, thereby reducing the volume of the displaced blood. In addition, the required volume of the air inflow to achieve the desired level of surface pressure is increased.

Lastly, the amount of fluid that is required to operate each applicator is still yet further dependent on the sliding of the shell down the limb towards a thinner section of the limb, thereby increasing the volume that has to be occupied by the expanding balloon. This factor greatly reduces the efficiency of the applicator by requiring a larger amount of air inflow to achieve the desired surface limb pressure.

Ideally, if the outer shell of the applicator is constructed to be rigid and to closely follow the contour of the enclosing limb surface (while allowing room for the pressure producing balloon), and prevented from shifting to the thinner side of the limb, the aforementioned increase in the internal volume of the applicator is almost totally eliminated. However, such rigid outer shells have to be constructed for each specific limb section of each individual to closely match their limb surface contour. Such relatively rigid applicator outer shells may be custom made using, for example various molding and rapid prototyping techniques known in the art, but with relatively high expense and by requiring an extended amount of time to produce the applicators for each individual patient.

SUMMARY OF THE INVENTION

Therefore it is an object of the present invention to provide a device and method for significantly reducing the aforementioned tendency of the outer shell of the applicator to expand and/or deform and thereby increase their internal volume as the internal balloon is pressurized.

Another objective of the present invention is to provide a device and method for minimizing the amount of soft tissue that is pushed out of the enclosed volume of the applicator.

Another objective of the present invention is to provide a device and method for minimizing the sliding of the applicator along the limb towards the thinner segments.

Accordingly, an applicator for applying an external counterpulsation to a body portion is provided. The applicator comprising: an outer shell for covering the body portion, the outer shell having a length in a longitudinal direction and a circumference in a circumferential direction; a balloon disposed in the outer shell, pressurization of which applies an external pressure to the body portion; and at least one anti-deformation member for reducing an amount of deformation of the outer shell caused by the pressurization of the balloon.

In a first preferred implementation, the at least one anti-deformation member preferably comprises a plurality of beam members disposed on an outer surface of the outer shell in the longitudinal direction. Preferably, the plurality of beam members are equally spaced along the circumference of the outer shell and at least one of the plurality of beam members has an I-beam cross-sectional shape.

Preferably, the plurality of beam members are disposed on the outer shell by threads that engage a portion of the beam members and a corresponding portion of the outer shell. Alternatively, the outer shell further comprises a pocket having an opening extending in the longitudinal direction for each of the plurality of beam members, wherein each of the plurality of beam members are disposed in a corresponding pocket. Preferably, the pockets are disposed on an outer surface of the outer shell. The pockets are preferably fastened to the outer shell by threads that engage a portion of the pockets and a corresponding portion of the outer shell.

At least one of the plurality of beam members preferably further comprises two or more beam segments, each of which are separated by a hinged joint to allow the beam member and outer shell to conform to a shape of the body portion in the longitudinal direction. Preferably, the hinged joint is a ball joint for allowing rotation of the beam segments in at least two directions. Alternatively, the hinged joint is a pinned joint for allowing rotation of the beam segments in a direction parallel to the longitudinal direction. The outer shell has a first and second end separated in the longitudinal direction by the length, wherein at least one of the plurality of beam members is preferably attached to the outer shell at each of the first and second ends.

In another preferred implementation, the applicator further comprises at least one transverse element disposed between at least two adjacent beam members of the plurality of beam members. Preferably, the at least one transverse element extends in the circumferential direction of the outer shell. The at least one transverse element can extend only in the circumferential direction or alternatively, the at least one transverse element comprises first and second transverse elements, the first and second transverse elements criss-crossing in the circumferential direction.

In another alternative, the at least one transverse element comprises a solid plate having a length substantially equivalent to the length of the outer shell. In another alternative, the at least one transverse element extends concavely in the circumferential direction.

In yet another alternative, the at least one anti-deformation member comprises constructing at least a portion of the outer shell with a plurality of truss elements which extend in the longitudinal direction. Preferably, each of the plurality of truss elements comprises a triangular truss element. The triangular truss elements preferably have a top and two angled sides, the top extends in the circumferential direction and the two angled sides extend in the longitudinal direction. The anti-deformation member preferably further comprises an outer sheet disposed on the tops of each of the triangular truss elements. Preferably the triangular truss elements and sheet member further comprise Velcro disposed between the tops and the outer sheet for connecting the outer sheet to the tops. Preferably, the plurality of truss elements are formed on a bottom sheet, the bottom sheet having a joint formed between adjacent truss elements. At least one of the joints is preferably a living joint formed in the bottom sheet.

In yet another preferred implementation, the applicator further comprises means for preventing tissue from bulging out from the first and second ends of the outer shell due to the pressurization of the balloon. Preferably, the means for preventing tissue from bulging out from the first and second ends comprises a collar disposed around the body portion adjacent each of the first and second ends. The collar preferably comprises a thin flexible material wrapped around the body portion adjacent each of the first and second ends to a desired height.

In still yet another preferred implementation the applicator further comprises means for preventing movement of the outer shell in the longitudinal direction. Preferably, the means for preventing movement of the outer shell in the longitudinal direction comprises a flexible material wrapped around both the first and second ends of the outer shell and the corresponding body portion adjacent the first and second ends. Where the applicator further comprises the means for preventing movement of the outer shell in the longitudinal direction, the means for preventing movement of the outer shell in the longitudinal direction preferably comprises a flexible material wrapped around both the first and second ends of the outer shell and the corresponding collars.

Also provided is a method for applying an external counterpulsation to a body portion. The method comprising: covering the body portion with an outer shell, the outer shell having a length in a longitudinal direction and a circumference in a circumferential direction; disposing a balloon in the outer shell; pressurizing the balloon to apply an external pressure to the body portion; and disposing at least one anti-deformation member in or on the outer shell for reducing an amount of deformation of the outer shell caused by the pressurization of the balloon.

BRIEF DESCRIPTION OF THE DRAWINGS

These and other features, aspects, and advantages of the apparatus and methods of the present invention will become better understood with regard to the following description, appended claims, and accompanying drawings where:

DETAILED DESCRIPTION OF THE PREFERRED EMBODIMENT

Although this invention is applicable to numerous and various types of applicators and fluids for use therein, it has been found particularly useful in the environment of applicators for use on limbs that operate with air. Therefore, without limiting the applicability of the invention to applicators for limbs that operate with air, the invention will be described in such environment.

As used herein, the term "longitudinal" refers to the direction along a limb's length, while the term "radial" refers to the direction perpendicular to the longitudinal direction. Further, "circumference" and "circumferential direction" refer to the length and direction, respectively, around the applicator as shown in cross-section. Although, the applicators are shown as having a circular or near-circular cross-section in the Figures, they are shown as such by way of example only and not to limit the scope or spirit of the present invention. Further, the terms "circumference" and "circumferential direction" are not to be interpreted to only cover such circular or near-circular configurations.

In general, there are at least four modes of deformation that contribute to the aforementioned increase in the internal volume of the outer shell as the balloon is pressurized. Each of these four modes of deformation will now be fully explained and preferred implementations of devices and methods for minimizing them are described with regard to the Figures. To this end, simplified models of the applicator's outer shell structure are utilized to describe each mode of deformation and the devices and methods of countering them. However, it is appreciated by those of ordinary skill in the art, that the devices and methods described herein can be utilized with applicator's of varying complexity and configuration without departing from the scope or spirit of the present invention.

Mode 1: Longitudinal Deformation of the Outer Shell

Figure 1:
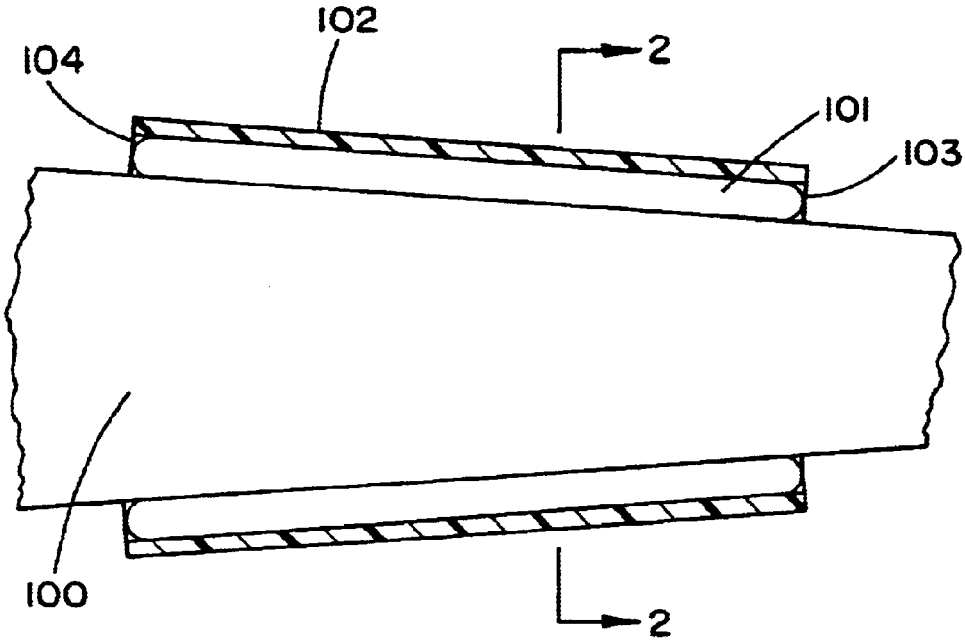
FIG. 1 (PRIOR ART)
FIG. 1 illustrates a longitudinal sectional view of an applicator of the prior art shown disposed about a patient's limb.
Figure 2:
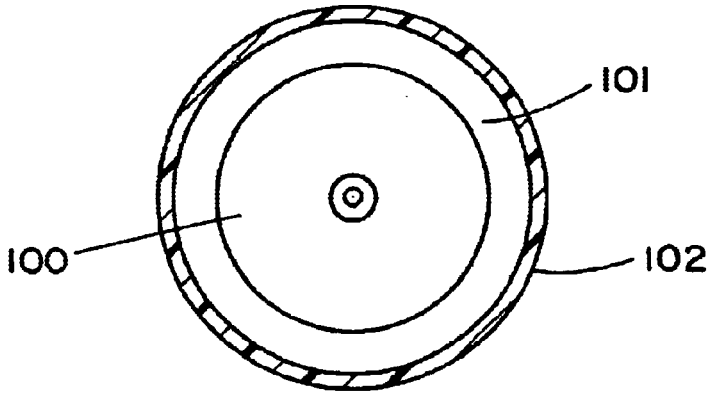
FIG. 2 (PRIOR ART)
FIG. 2 illustrates a radial sectional view of the applicator of FIG. 1 as taken along line 2—2 in FIG. 1.
Figure 3:
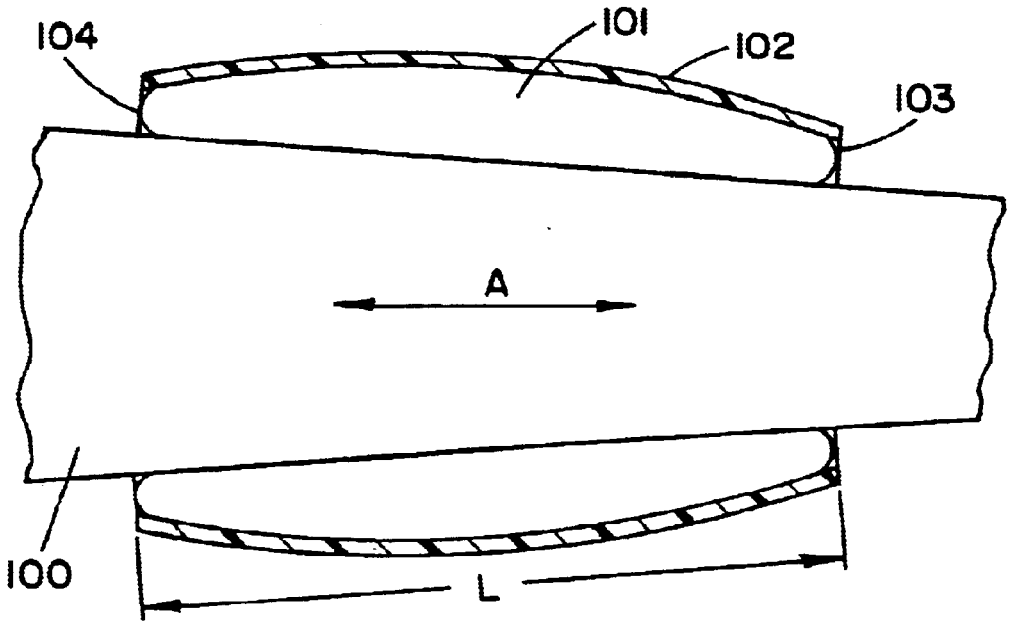
FIG. 3 (PRIOR ART)
FIG. 3 illustrates the applicator of FIG. 2 in which the shell is deformed in a longitudinal direction.

Referring now to FIG. 3, the first mode of deformation is illustrated therein. This mode of deformation is the result of the outer shell 102 bulging out in the longitudinal plane as the balloon 101 is pressurized. In this mode, the outer shell 102 is deformed outward along a length "L" in a longitudinal direction (A) in a mode similar to bending in beams that are under a distributed bending pressure (force). This mode of deformation occurs even if the outer shell 102 fabric is relatively non-extensible and cannot therefore readily expand in the radial and longitudinal directions since the outer shell 102 is relatively free to contract longitudinally due to the fact that first and second sides 103, 104 are not held a relatively fixed distance apart.

Figure 4:
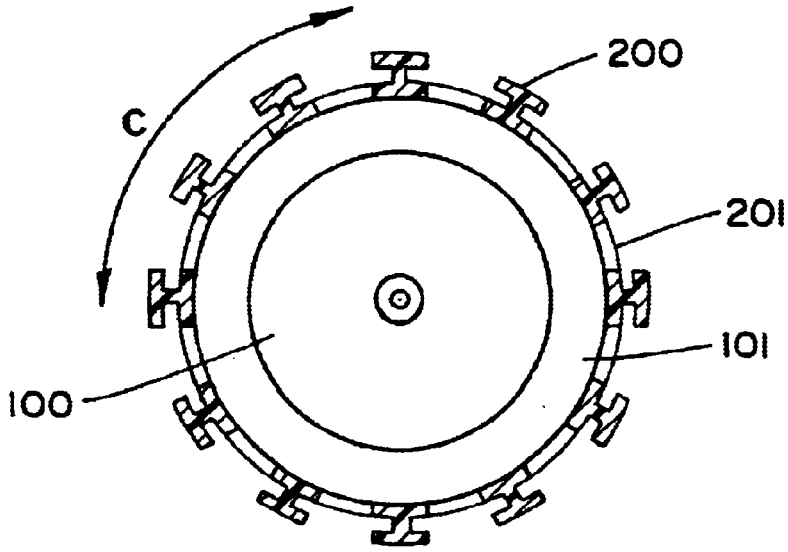
FIG. 4 illustrates a radial sectional view of a first variation of a preferred implementation of an applicator of the present invention.

Referring now to FIG. 4 therein is shown a preferred implementation of an applicator that prevents or reduces the longitudinal bulging of the shell shown in FIG. 3. The outer shell 201 has beam members 200 with appropriate bending stiffness that are placed longitudinally and held against an outer shell 201. The beam members are attached or otherwise firmly held against the non-extensible fabric of the outer shell 201 and disposed along the circumferential direction (C), preferably equally spaced about the circumference of the outer shell 201. In general, any number of such beam members 200 may be employed. At the limit, the outer shell 201 may be made entirely of such beam members 200 that are placed very close to each other or even side by side and held together by relatively non-extensible fabric or other material. However, it is preferred that a certain amount of spacing between the beam members 200 be provided to reduce the weight of the outer shell 201 and make it easier to apply to the limb segment. The beam members 200 are preferred to be held together by the aforementioned relatively non-extensible fabric of the outer shell 201 to prevent the radial expansion of the shell 201 under the balloon pressure. Such an arrangement of the longitudinally positioned beam members around the periphery of the thigh is shown in the cross-sectional view of FIG. 4.

In FIG. 4, I-beam type beam members 200 are shown. Such sections are preferred since they provide high bending stiffness with low cross-sectional area; thereby low weight per unit length of the beam members 200 for a required level of bending stiffness. However, it will be appreciated by those of ordinary skill in the art that due to other considerations, such as manufacturing and assembly considerations, beam members 200 with other cross-sectional areas may also be used as long as they are sized to provide the required bending stiffness.

Figure 5:
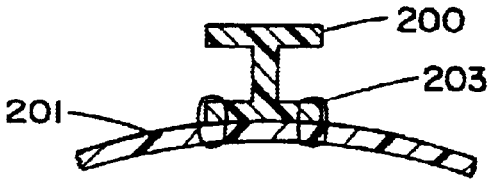
FIG. 5 illustrates a first variation of a partial enlarged view of the applicator of FIG. 4.
Figure 6:
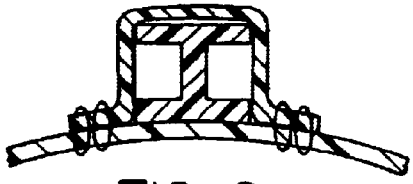
FIG. 6 illustrates a second variation of a partial enlarged view of the applicator of FIG. 4.

In FIG. 4, the beam members 200 are shown arranged around the limb segment 100, which is covered by the balloon 101. The beam members 200 are fixed to the non-extensible material of the outer shell 201, preferably a fabric or similar non-extensible material with bending flexibility to prevent outward radial expansion of the beam members 200 and outer shell 201 assembly. The beam members 200 and the non-extensible fabric like material of the outer shell 201 may be assembled in a variety of ways such as by permanently attaching the beam members 200 to the relatively non-extensible fabric outer shell 201, for instance by using similar fabric threads 203 as shown in FIG. 5. Alternatively, the beam members 200 can be firmly encased in pockets 204 that are provided in the relatively non-extensible fabric shell 201, for instance as shown in FIG. 6. The pockets 204 can be integrally formed with the shell 201 or attached thereto, such as by threads 205.

The device and method illustrated in FIG. 6 are preferred since it is easier to manufacture, assemble and apply to the limb segment. In addition, the pockets 204 can be filled with the beam members 200 as needed to prevent the bulging out of the applicator under balloon pressure.

Figure 7:
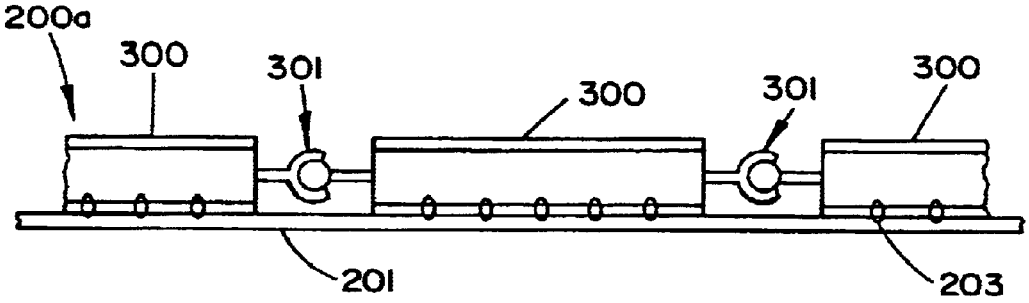
FIG. 7 illustrates a longitudinal view of a first variation of the beam members of FIG. 4.
Figure 8:
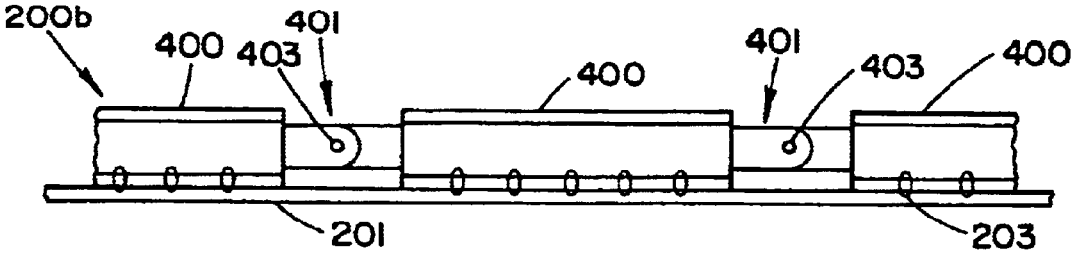
FIG. 8 illustrates a longitudinal view of a second variation of the beam members of FIG. 4.

Referring now to FIGS. 7 and 8, there are shown first and second variations of the beam members, referred to by reference numerals 200*a* and 200*b*, respectively. The beam members 200*a* and 200*b* illustrated in FIGS. 7 and 8 are shown in the longitudinal direction (along the length of the applicator). FIGS. 7 and 8 illustrate the stiffening beam members 200, particularly when encased in the pockets 204, constructed as beam segments 300, 400 that are hinged together, preferably with spherical (ball) joints 301 or simple hinged (pin) joints 401 with their axes of rotation perpendicular to the long axis of the beam segments 400 and directed in the transverse direction in the assembled applicator. In FIG. 7, three beam segments 300 with their long axes 302 are shown connected with spherical joints 301. In FIG. 8, three beam segments 400 with their long axes 402 are shown connected with the simple hinge joints 401 that allow relative rotation of the beam segments about axes 403 which are perpendicular to the axes 402. Such beam members 200*a*, 200*b* allow the outer shell 201 to be readily contoured to the outer surface geometry of the limb segment, but would still prevent the aforementioned bulging of the outer shell 201 since the total length of the beam members 200*a*, 200*b* cannot be reduced. In both cases, the ends of the segmented beam members 200*a*, 200*b* are firmly attached to the first and second ends 103 and 104 of the outer shell 201.

Mode 2: Radial Expansion of the Outer Shell

This mode of deformation refers to the radial expansion of the outer shell 201 due to its elastic behavior as the inner balloon 101 is pressurized. As a result, even if longitudinal bulging of the outer shell 201 is prevented by the aforementioned beam members 200, the volume enclosed by the outer shell 201 is increased, thereby increasing the amount of fluid that has to be pumped into the balloon(s) 101 to achieve the desired level of limb surface pressure.

This mode of deformation can be prevented by using a relatively non-extensible fabric or the like to construct the outer shell 201 as described for the previous mode of deformation. Alternatively, this mode of deformation can be prevented by preventing radial expansion of the outer shell 201 using one or more straps (not shown) of relatively non-extensible material that are wrapped over the outer shell 201 and locked in place by VELCRO or other similar means. The straps may be of various widths. One may even use a single "strap" that is the length of the outer shell 201. On the other hand, a string or band (not shown) of relatively non-extensible material may be also be used to wrap around the outer shell 201 and secured in place.

The latter is generally preferable since an outer shell 201 is generally required and might as well be constructed with relatively non-extensible material and eliminate the need for secondary means of preventing radial expansion of the outer shell. Such a solution would also serve the purpose of minimizing local bulging of the outer shell 201 as described below for the third mode of deformation.

Mode 3: Local Bulging of the Outer Shell

Figure 9:
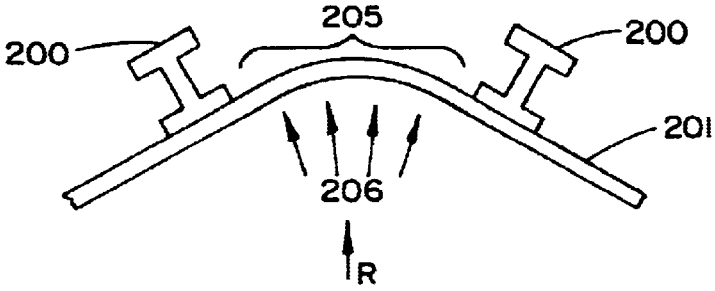
FIG. 9 illustrates a partial radial sectional view of the applicator of FIG. 4 that has a portion of radial bulging.

Referring now to FIG. 9, this mode of deformation refers to the bulging of the outer shell 201 in the radial direction (R) between the aforementioned stiffening beam members 200 and any other additional stiffening elements (e.g., stiffening elements positioned between the beam members 201) as is shown in FIG. 9. This bulging occurs when a portion of the outer shell surface 205 is unsupported by such longitudinal and/or transverse stiffeners and is subject to pressure generated by the underlying balloons. Such local bulging of the outer shell 201 within two longitudinal beam members 200 while under balloon pressure 206 is shown in FIG. 9. Such bulging occurs even if the outer shell 201 is relatively non-extensible, but less severely.

Figure 10:
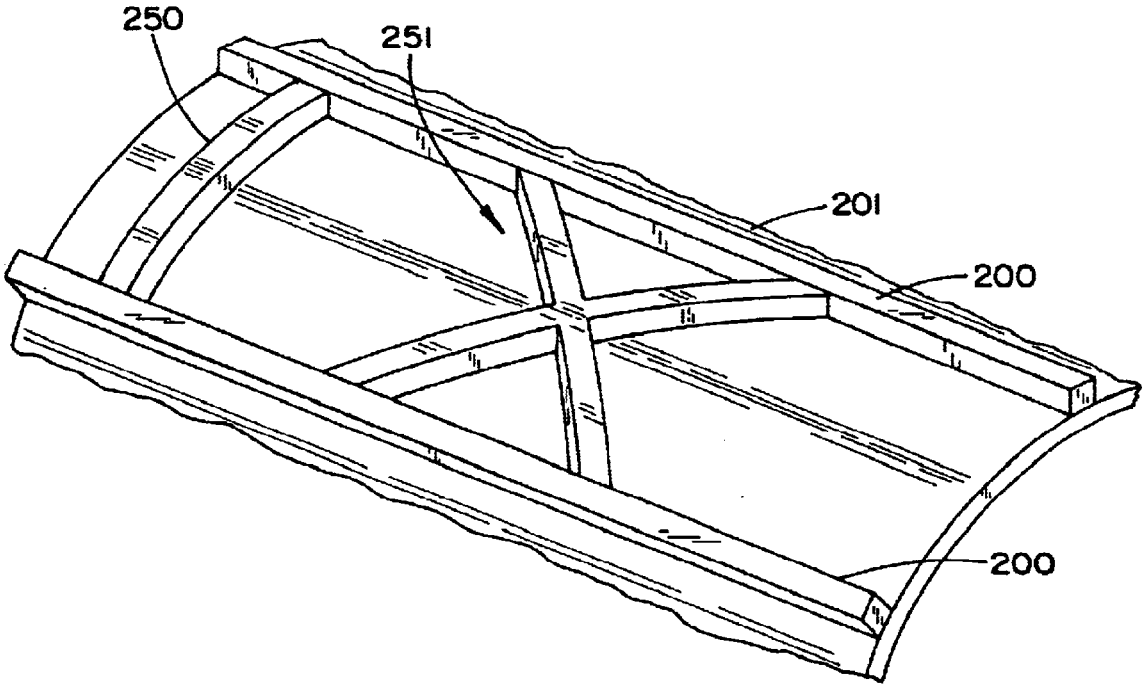
FIG. 10 illustrates transverse elements connected between two beam members.
Figure 11:
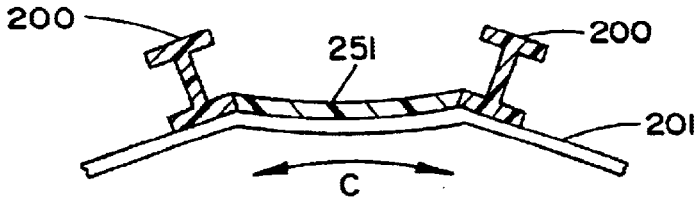
FIG. 11 illustrates a partial radial view of the applicator of FIG. 4 that has a transverse element disposed between two beam members.

Although such outward bulging can be reduced by reducing the distance between the beam members 200, or by using a larger number of beam members 200 (with less bending stiffness) it is preferred that the bulging be minimized by adding transverse elements 250 to connect the beam members 200 at a number of positions along the length of the beam members as is shown in FIGS. 10 and 11. Thus, the transverse elements 250 extend in the circumferential direction (C) of the outer shell 201. Although the transverse elements 250 are shown as simple straight elements they may be placed in any other pattern to bridge the beam members 200 as long as they result in smaller exposed outer shell areas, for instance in a crisscrossed pattern of elements 251 connecting the beam elements 200. The transverse elements 250 may also be a solid plate connecting the beam members 200. The solid plate having a length substantially equivalent to the length (L) of the outer shell 201. Lastly, such outer bulging can be minimized by employing curved transverse elements 252 that are secured to the beam members 200 as shown in FIG. 11. Transverse element 251 is shown in FIG. 11 as extending concavely in the circumferential direction.

Mode 4: Change in the Shape of the Outer Shell Cross Section in the Radial Plane This mode of deformation refers to the situation in which the shape of the cross-section of the outer shell 201 of the applicator in the radial plane before the balloon is pressurized is non-circular, which is most often the case. In general, a non-circular shell under internal pressure (of the balloons for the present applicators) tends to become circular. As the outer shell 201 tends to become more circular, the area within the shell 201 cross-section and thereby the internal (enclosed) volume of the applicator would tend to increase.

Figure 12:
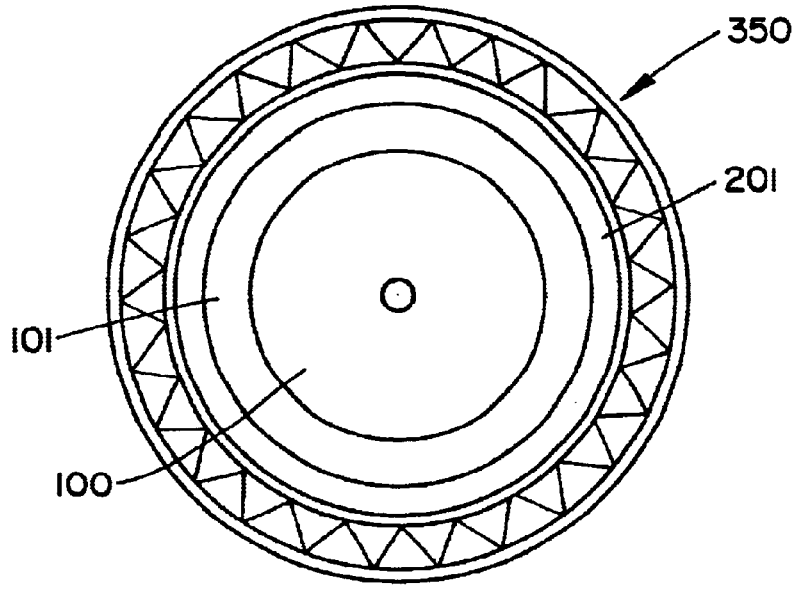
FIG. 12 illustrates a truss structure disposed around an applicator and limb.

To prevent such deformations the outer shell 201 can be enclosed with a structure that has a bending rigidity. A preferred implementation of such structures is a truss structure. However, since the structure has to be deformable while the applicator is being assembled around the limb, it is preferred that the structure be fully or partially formed with jointed (pin and/or spherical joints or their equivalent living joints) elements and rigidified during the assembly after it is placed around the applicator. For this reason, triangular truss structures or their equivalent are preferred. The schematic of such a structure 350 is shown in FIG. 12.

Figure 13:
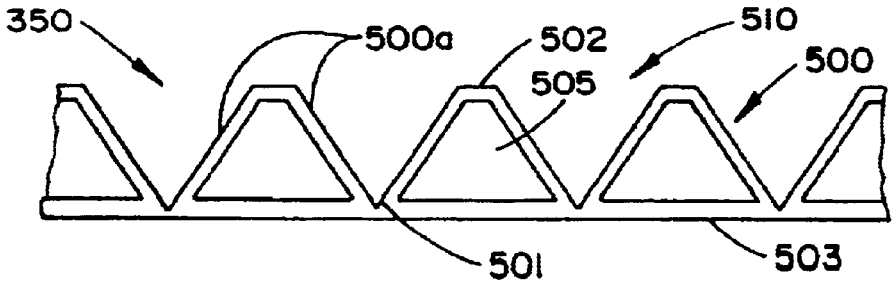
FIG. 13 illustrates a partial view of a sheet member used to fabricate the truss structure of FIG. 12.

Referring now to FIG. 13, in practice, such a triangular truss structure 350 can be readily assembled around the, limb and is preferably constructed as a sheet member 510 of relatively hard material, such as plastic, and is preferably extruded. The sheet member 510 is preferably formed with triangular or other similar cross-sectioned truss elements 500 with appropriate stiffness in its plane and bending stiffness so that the truss elements 500 could take the place of the beam elements 200. The truss elements 500 are extruded with a bottom sheet portion 503 with living joints 501 formed therein between each of the truss elements 500 so that the sheet member 510 can be formed into a circular or near circular configuration as shown in FIG. 12. The tops or top surface ridges 502 of the elements 500 are either roughened or provided with VELCRO.

Figure 14:
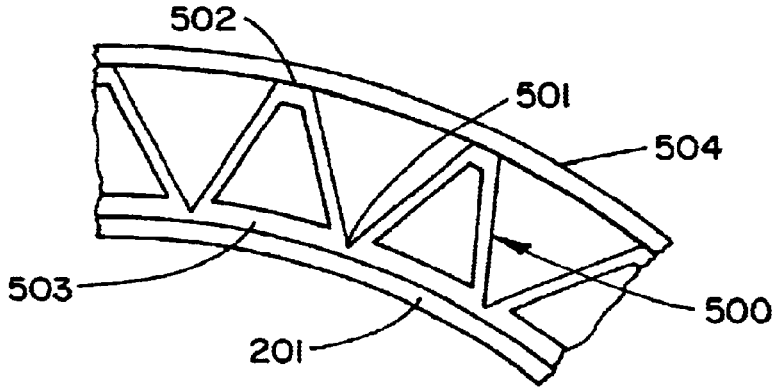
FIG. 14 illustrates a partial view of the truss structure of FIG. 12 having an outer layer formed thereon.

Referring now to FIG. 14, during the assembly, the sheet member 510 is formed into the shape of the outer surface of the outer shell 201 and covered limb. An outer sheet 504 which can be a sheet made out of a relatively non-extensible material is preferably wrapped around the assembly to secure the sheet member 510. The outer sheet 504 is held securely in place by means of outer straps (not shown) or the like. The outer layer 504 is preferably secured to the ridges 502 of the sheet member 510 by means of VELCRO, friction or the like. The desired triangular truss structure 350 is thus formed. For the truss structure 350 to provide the desired rigidity, the longitudinal sides 500*a* of each element 500 should be relatively rigid and provide enough resistance to buckling. For this reason, the outer sheet 504 must be thick and have enough stiffness (e.g., stiffened by outer ribs) to withstand maximum compressive and bucking forces. As a result, all sides 500*a* of the elements 500 and thereby the truss structure 350 is made rigid and can therefore resist change in its geometry as the balloon(s) 101 are pressurized.

Figure 15:
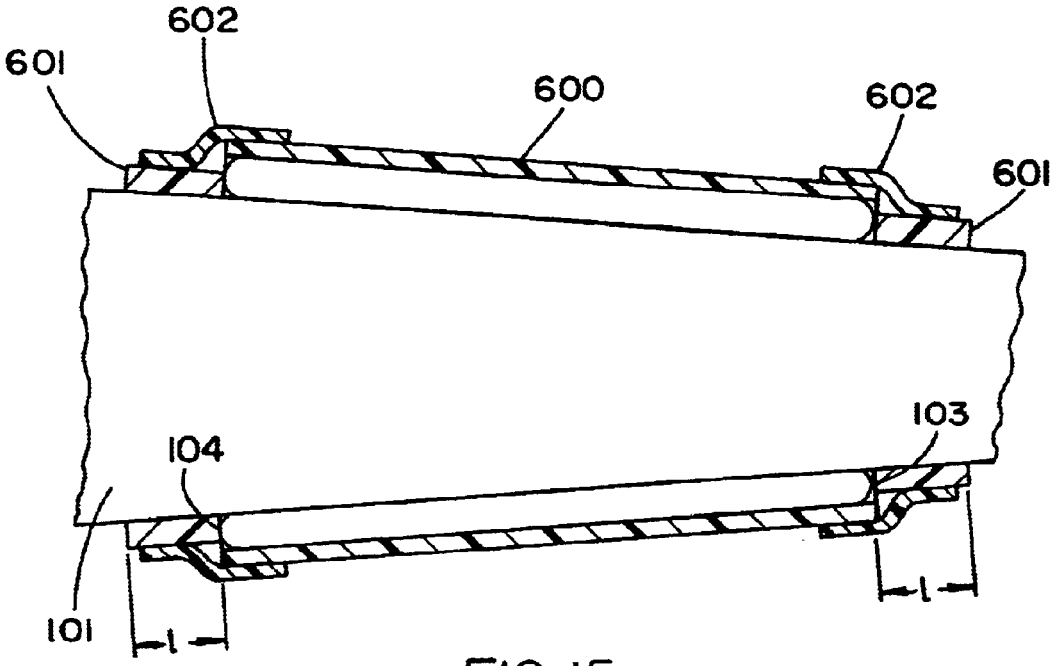
FIG. 15 illustrates a sectional view of an applicator in a longitudinal direction showing preferred implementations of both a means for preventing tissue from bulging out of the first and second ends and means for preventing a movement of the applicator in the longitudinal direction.

Referring now to FIG. 15, to prevent a volume of the soft tissue to be pushed out of the sides of the applicator enclosure, segments of the limb before and after the applicator are prevented from "bulging out" by a means for preventing the tissue from bulging out of the first and second ends 103, 104. This can be readily accomplished by disposing a collar 601 on the limb or other body portion adjacent the first and second ends 103, 104. Preferably, the collar 601 comprises a relatively non-extensible sheet of flexible material 601 wrapped around the limb 603 at the first and second ends 103, 104 of the applicator 600. Obviously, the longer the length (l) of the wrapped elements 601 and the more resistant they are to the deformations described in the aforementioned modes, the more resistance they would provide to soft tissue displacement.

The applicator slippage problem is addressed by providing a means for preventing movement of the applicator in the longitudinal direction (L), preferably, by ensuring that the surface of the applicator that is in contact with the limb (directly or through the intermediate layer of highly air permeable material) provides enough "frictional" or "sticktion" force to prevent its slippage towards the thinner segment of the limb. In addition or in place of such means of preventing slippage, the elements 601 are preferably used to provide the required resistance to slippage. This can be accomplished by selecting a material for elements 601 or by coating the surfaces that are in contact with the limb surface with materials that provide enough friction or sticktion between the elements 601 and the limb surface. In which case, the ends of the applicator have to be secured to the elements 601 directly or by the intermediate sheets of flexible material 602, which is preferably wrapped around the first and second ends 103, 104 and the portions of the body adjacent the applicator (or alternatively, the collars 601).

While there has been shown and described what is considered to be preferred embodiments of the invention, it will, of course, be understood that various modifications and changes in form or detail could readily be made without departing from the spirit of the invention. It is therefore intended that the invention be not limited to the exact forms described and illustrated, but should be constructed to cover all modifications that may fall within the scope of the appended claims.

What is claimed is:

1. An applicator for applying an external counterpulsation to a body portion, the applicator comprising:

an outer shell for covering the body portion, the outer shell having a length in a longitudinal direction and a circumference in a circumferential direction;

a balloon disposed in the outer shell, pressurization of which applies an external pressure to the body portion; and at least one anti-deformation member for reducing an amount of deformation of the outer shell caused by the pressurization of the balloon;

wherein the at least one anti-deformation member comprises a plurality of beam members disposed on an outer surface of the outer shell in the longitudinal direction, at least one of the plurality of beam members having a principle moment of inertia in a radial direction.

2. The applicator of claim 1, wherein the plurality of beam members are equally spaced along the circumference of the outer shell.

3. The applicator of claim 1, wherein the at least one of the plurality of beam members has an I-beam cross-sectional shape.

4. The applicator of claim 1, wherein the plurality of beam members are disposed on the outer shell by threads which engage a portion of the beam members and a corresponding portion of the outer shell.

5. The applicator of claim 1, wherein the outer shell further comprises a pocket having an opening extending in the longitudinal direction for each of the plurality of beam members, wherein each of the plurality of beam members are disposed in a corresponding pocket.

6. The applicator of claim 5, wherein the pockets are disposed on an outer surface of the outer shell.

7. The applicator of claim 6, wherein the pockets are fastened to the outer shell by threads which engage a portion of the pockets and a corresponding portion of the outer shell.

8. The applicator of claim 1, wherein at least one of the plurality of beam members further comprises two or more beam segments, each of which are separated by a hinged joint to allow the beam member and outer shell to conform to a shape of the body portion in the longitudinal direction.

9. The applicator of claim 8, wherein the hinged joint is a pinned joint for allowing rotation of the beam segments in a direction parallel to the longitudinal direction.

10. The applicator of claim 8, wherein the hinged joint is a ball joint for allowing rotation of the beam segments in at least two directions.

11. The applicator of claim 1, wherein the outer shell has a first and second end separated in the longitudinal direction by the length, wherein at least one of the plurality of beam members is attached to the outer shell at each of the first and second ends.

12. The applicator of claim 1, further comprising at least one transverse element disposed between at least two adjacent beam members of the plurality of beam members.

13. The applicator of claim 12, wherein the at least one transverse element extends in the circumferential direction of the outer shell.

14. The applicator of claim 13, wherein the at least one transverse element extends only in the circumferential direction.

15. The applicator of claim 13, wherein the at least one transverse element comprises first and second transverse elements, the first and second transverse elements criss-crossing in the circumferential direction.

16. The applicator of claim 13, wherein the at least one transverse element comprises a solid plate having a length substantially equivalent to the length of the outer shell.

17. The applicator of claim 13, wherein the at least one transverse element extends concavely in the circumferential direction.

18. The applicator of claim 1, further comprising means for preventing tissue from bulging out from the first and second ends of the outer shell due to the pressurization of the balloon.

19. The applicator of claim 18, wherein the means for preventing tissue from bulging out from the first and second ends comprises a collar disposed around the body portion adjacent each of the first and second ends.

20. The applicator of claim 19, wherein the collar comprises a thin flexible material wrapped around the body portion adjacent each of the first and second ends to a desired height.

21. The applicator of claim 19, further comprising means for preventing movement of the outer shell in the longitudinal direction, wherein the means for preventing movement of the outer shell in the longitudinal direction comprises a flexible material wrapped around both the first and second ends of the outer shell and the corresponding collars.

22. The applicator of claim 1, further comprising means for preventing movement of the outer shell in the longitudinal direction.

23. The applicator of claim 22, wherein the means for preventing movement of the outer shell in the longitudinal direction comprises a flexible material wrapped around both the first and second ends of the outer shell and the corresponding body portion adjacent the first and second ends.

24. A method for applying an external counterpulsation to a body portion, the method comprising:

covering the body portion with an outer shell, the outer shell having a length in a longitudinal direction and a circumference in a circumferential direction;

disposing a balloon in the outer shell;

pressurizing the balloon to apply an external pressure to the body portion; and disposing at least one anti-deformation member in or on the outer shell for reducing an amount of deformation of the outer shell caused by the pressurization of the balloon, the at least one anti-deformation member comprising a plurality of beam members disposed on an outer surface of the outer shell in the longitudinal direction, at least one of the plurality of beam members having a principle moment of inertia in a radial direction.

25. An applicator for applying an external counterpulsation to a body portion, the applicator comprising:

an outer shell for covering the body portion, the outer shell having a length in a longitudinal direction and a circumference in a circumferential direction;

a balloon disposed in the outer shell, pressurization of which applies an external pressure to the body portion; and at least one anti-deformation member for reducing an amount of deformation of the outer shell caused by the pressurization of the balloon;

wherein the at least one anti-deformation member comprises constructing at least a portion of the outer shell with a plurality of truss elements which extend in the longitudinal direction.

26. The applicator of claim 25, wherein each of the plurality of truss elements comprises a triangular truss element.

27. The applicator of claim 26, wherein the triangular truss elements have a top and two angled sides, the top extending in the circumferential direction and the two angled sides extending in the longitudinal direction.

28. The applicator of claim 27, further comprising an outer sheet disposed on the tops of each of the triangular truss elements.

29. The applicator of claim 28, further comprising Velcro disposed between the tops and the outer sheet for connecting the outer sheet to the tops.

30. The applicator of claim 25, wherein the plurality of truss elements are formed on a bottom sheet, the bottom sheet having a joint formed between adjacent truss elements.

31. The applicator of claim 30, wherein at least one of the joints is a living joint formed in the bottom sheet.

* * * * *